US010072408B2

(12) United States Patent
Huynh

(10) Patent No.: US 10,072,408 B2
(45) Date of Patent: Sep. 11, 2018

(54) WATER SAVING TOILET SYSTEM

(71) Applicant: Quang Le Huynh, Lysterfield (AU)

(72) Inventor: Quang Le Huynh, Lysterfield (AU)

(73) Assignee: Quang Le Huynh (AU)

( * ) Notice: Subject to any disclaimer, the term of this patent is extended or adjusted under 35 U.S.C. 154(b) by 0 days.

(21) Appl. No.: 15/032,272

(22) PCT Filed: Oct. 23, 2014

(86) PCT No.: PCT/AU2014/001000
§ 371 (c)(1),
(2) Date: Apr. 26, 2016

(87) PCT Pub. No.: WO2015/061830
PCT Pub. Date: May 7, 2015

(65) Prior Publication Data

US 2016/0251841 A1 Sep. 1, 2016

(30) Foreign Application Priority Data

Oct. 29, 2013 (AU) ..... 2013904173

(51) Int. Cl.

| | |
|---|---|
| ***E03D 11/10*** | (2006.01) |
| ***E03D 9/052*** | (2006.01) |
| ***E03D 5/00*** | (2006.01) |
| ***E03D 3/12*** | (2006.01) |
| ***E03D 5/10*** | (2006.01) |

(52) U.S. Cl.
CPC ..... *E03D 11/10* (2013.01); *E03D 3/12* (2013.01); *E03D 5/003* (2013.01); *E03D 5/10* (2013.01); *E03D 9/052* (2013.01); *E03D 2201/30* (2013.01)

(58) Field of Classification Search
CPC E03D 11/10; E03D 3/12; E03D 5/003; E03D 5/10
USPC ..... 4/324, 326, 665, 348
See application file for complete search history.

(56) References Cited

U.S. PATENT DOCUMENTS

| | | | |
|---|---|---|---|
| 8,336,128 | B2 | 12/2012 | Murphy |
| 2007/0174959 | A1 | 8/2007 | Sanders et al. |

FOREIGN PATENT DOCUMENTS

| | | | |
|---|---|---|---|
| EP | 2014837 | A2 | 1/2009 |
| WO | 2013145999 | A1 | 4/2015 |
| WO | 2015061830 | A1 | 5/2015 |

OTHER PUBLICATIONS

International Search Report, PCT/AU2014/001000, dated Feb. 12, 2015.

*Primary Examiner* — Tuan N Nguyen
(74) *Attorney, Agent, or Firm* — Brooks Kushman P.C.

(57) ABSTRACT

A water saving toilet system having a toilet including a toilet bowl having an upper portion and a lower portion, at least one valve interposed between a first water source and a second water source and the toilet bowl for controlling at least one volume of water flowing from the first water source and/or the second water source to the toilet bowl and a timing mechanism connected to the at least one valve for controlling an amount of time that the valve allows water to flow from the first water source and/or the second water source to the toilet bowl, wherein the at least one valve and the timing mechanism cooperate to adjust the flush volume.

15 Claims, 3 Drawing Sheets

WATER SAVING TOILET SYSTEM

CROSS-REFERENCE TO RELATED APPLICATION

This application is the U.S. national phase of PCT Application No. PCT/AU2014/001000 filed on Oct. 23, 2014, which claims priority to AU Patent Application No. 2013904173 filed on Oct. 29, 2013, the disclosures of which are incorporated in their entirety by reference herein.

FIELD OF THE INVENTION

The present invention relates to toilets and toilet flushing systems. In particular, but not exclusively, the present invention relates to a water saving toilet system which provides an adjustable flush volume for a toilet. However, it will be appreciated that the present invention has broader application and is not limited to that particular use.

BACKGROUND TO THE INVENTION

Older model toilet tanks in homes and apartments can hold up to 12 liters of water and use essentially all of this volume with each flush. With the recognition in recent years that water is a valuable resource and in short supply in many countries, modern toilet tanks have been designed to accomplish toilet bowl evacuation with as little as 3 liters per flush using a half-flush option.

Under the current Australian toilet standards, toilets in the 4.5/3 L class are the lowest volume flush toilets permissible. In overseas markets however, other capacities are commonly available such as 4/2 L dual-flush toilets in Europe and 3/2 L dual-flush toilets in Scandinavia. Such models are unable to be successfully introduced into the Australian market as these classes of toilet are currently ineligible for registration under the current Australian toilet standards (AS 1172.1 and AS 1172.2). Hence, it would be desirable to have a solution which ameliorates this problem by enabling the flush volume to be adjusted to suit Australian and overseas toilet standards.

European Patent No. 2196585 discloses a toilet bowl with flush flow control comprising a toilet bowl, a set of valves and an electric pump. The bowl has an upper rim with an upper valve connected to a first injection duct and a well with a lower valve connected to a second injection duct, whereby water passes through the injection ducts to clean the toilet bowl and well. The set of valves is fed by an electric pump which may or may not be submersed in a flush tank and be controlled by an electronic system.

U.S. Pat. No. 5,216,761 discloses a flush volume control device for flush type toilets equipped with a valve which is opened to allow flush water to flow from the toilet into its bowl and then closed. The flush volume control engages a pivotably mounted, flapper valve bracket as the level of flush water in the toilet tank recedes upon the toilet being flushed and thereafter continues downwardly, displacing the valve to a closed position even though a considerable volume of water may remain in the tank. This provides a reduced volume flush of the toilet bowl. A vertically adjustable float component of the control allows the flush volume to be changed between wide limits at will. This mechanism requires a user to hold the flush lever until the tank is emptied to perform a full flush cycle and can possibly result in using more water if the reduced volume flush was not sufficient in the first instance.

U.S. Pat. No. 5,103,507 discloses a limited flush retrofit control device for toilet tanks suitable for both ball valve tanks and flapper valve tanks. A U-shaped horizontal thrust member with vertical arms attached to each side acts to effect closing of a ball valve or flapper valve. Each vertical arm is fitted with a float, adjusting clips and preferably with weights. The positioning of the clips is adjustable to alter the heights of the float on the vertical arm and determine the flush volume exiting the tank. Again this mechanism requires a user to hold the tank lever arm in the flush position until the tank is emptied to perform a full flush cycle. Furthermore, the device is complicated to adjust the flush volume.

U.S. Pat. No. 8,336,128 discloses a toilet comprising a valve interposed between a pressurized water supply and the toilet bowl for controlling a volume of water flowing from the water supply to the toilet bowl, and a timing mechanism connected to the valve for controlling an amount of time that the valve allows water to flow from the water supply to the toilet bowl. However, this system is complex, expensive to manufacture and difficult to function properly.

Many currently available water efficient toilets, including the inventions which are the subject of the abovementioned patents are comprised of cumbersome parts and/or complicated mechanisms which are costly to install, maintain and replace. Another major disadvantage of the prior inventions is that the selective flushing systems require a user to hold the flush handle or lever in order to empty the water tank and complete the flushing cycle. If the user releases the handle or lever too soon, insufficient water is used to flush the waste and multiple flushes may be required. Such a requirement can result in over flushing or under flushing, which can lead to more water consumption than would otherwise be necessary. Therefore, a need exists for a solution which is easy to use and compact and simple to install, maintain and replace.

The reference to any prior art in this specification is and should not be taken as, an acknowledgment or any form or suggestion that the prior art forms part of the common general knowledge in any country.

In this specification, the terms "comprises", "comprising" or similar terms are intended to mean a non-exclusive inclusion, such that a water saving toilet system that comprises a list of elements does not include those elements solely, but may well include other elements not listed.

OBJECT OF THE INVENTION

It is a preferred object of the present invention to provide water saving toilet system, that addresses or at least ameliorates one or more of the aforementioned problems of the prior art and/or provides a consumer with a useful or commercial choice.

SUMMARY OF THE INVENTION

Generally, embodiments of the present invention relate to a water saving toilet system.

According to one aspect, although not necessarily the broadest aspect, the present invention resides in a water saving toilet system, the system comprising:

a toilet comprising a toilet bowl having an upper portion and a lower portion;

at least one valve interposed between a first water source and a second water source and the toilet bowl for controlling at least one volume of water flowing from the first water source and/or the second water source to the toilet bowl;

a timing mechanism connected to the at least one valve for controlling an amount of time that the at least one valve allows water to flow from the first water source and/or the second water source to the toilet bowl; and wherein the at least one valve and the timing mechanism cooperate to adjust the flush volume.

Preferably, the water saving toilet system provides an adjustable flush volume range between 0.6 and 4.5 liters.

Preferably, the toilet bowl comprises a spraying ring having a plurality of jets to shoot water around the upper portion and flow along a first flowpath from the upper portion to the lower portion of the toilet bowl to both clean and refill the toilet bowl after evacuation.

Preferably, the toilet bowl further comprises a flush jet port mounted at a front area of the lower portion of the toilet bowl to shoot water around the lower portion and flow along a second flowpath which emulsifies and pushes the waste out of the flushing cavity and into and through a waste outlet at a rear of the lower portion of the toilet bowl into a sewage pipe.

Preferably, the first water source is a clean water source from a mains water supply and the second water source is a grey water supply from a household waste water supply.

Preferably, a first supply valve provides clean water from the first water source and a second supply valve and a third supply valve provide grey water from the second water source.

Suitably, the water saving toilet system further comprises a pair of check valves which are designed to prevent the mutual back flow of clean and grey water through water supply pipe lines.

Preferably, the water saving toilet system further comprises a connector having a waste valve device to enable waste to be flushed to the sewage pipe and keep a minimum amount of clean water in the lower part of the toilet bowl.

Suitably, an overflow pipe extends from the rear of the toilet bowl to the sewage pipe.

Suitably, the overflow pipe has a built-in anti-back flow to prevent any gases from the sewage pipe migrating to the toilet. Suitably, the water saving toilet system further comprises an exhaust system comprising a fan which is integrated within ducting pipe connected to the water saving toilet system for diverting all gases created from any sanitary processes to an outdoor space.

Preferably, the water saving toilet system further comprises a control box coupled to the toilet for controlling the operation of the water saving toilet system and housing the electronic componentry of the system.

Preferably, the control box will be powered operated via electricity with a provision for a manual flush option in the event of a power outage.

Preferably, the control box has two push buttons for providing the reduced volume flush and full volume flush functions.

Preferably, the system further comprises at least one bypass valve located between the first clean water source and the second grey water source such that, the water saving toilet system, can still be utilised in circumstances where there is no second grey water source.

Further features and forms of the present invention will become apparent from the following detailed description.

BRIEF DESCRIPTION OF THE DRAWINGS

In order that the invention may be readily understood and put into practical effect, reference will now be made to embodiments of the present invention with reference to the accompanying drawings, wherein like reference numbers refer to identical elements. The drawings are provided by way of example only, wherein.

Figure 1:
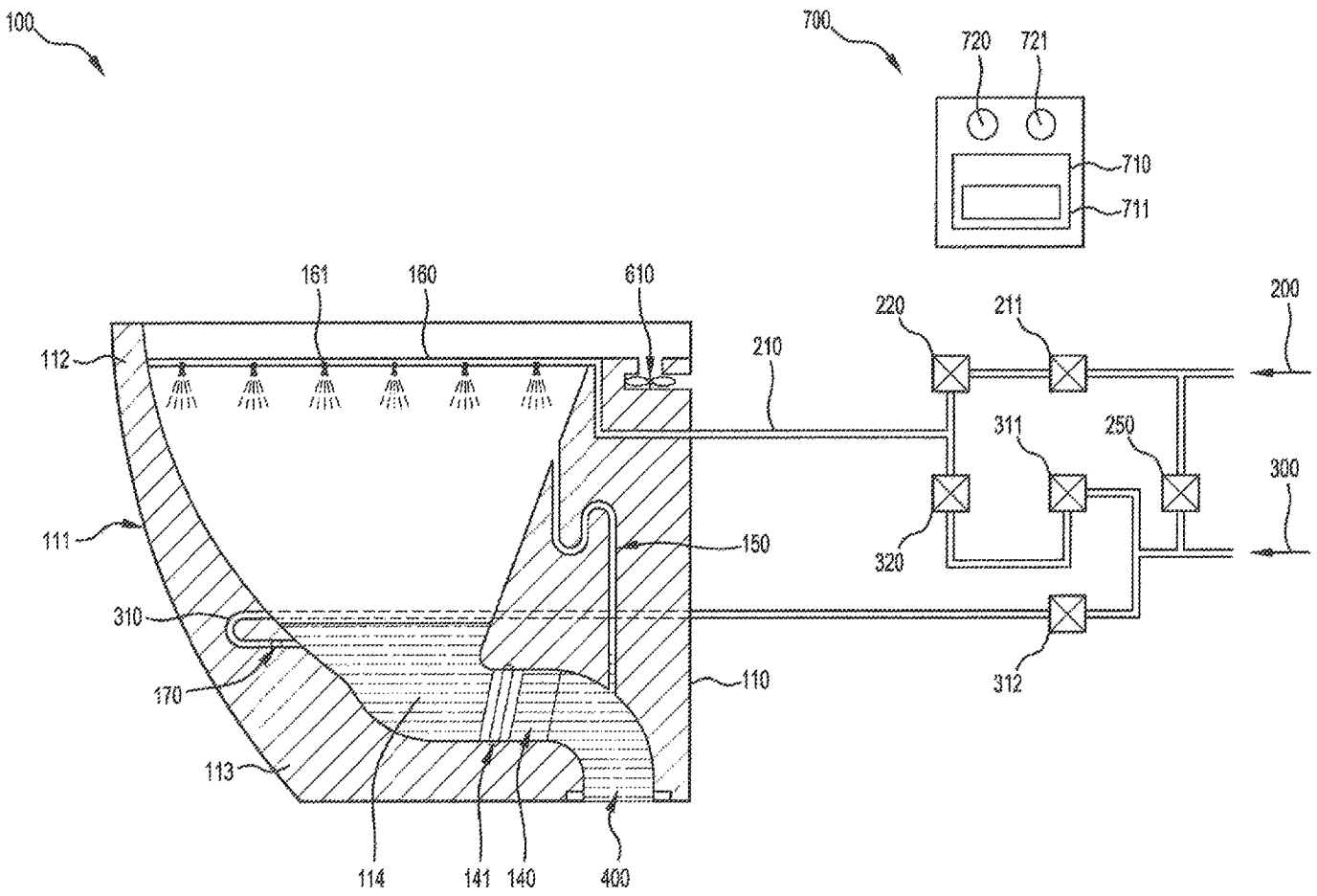
FIG. 1 shows a side cross-sectional view of the water saving toilet system according to an embodiment of the present invention.

Skilled addressees will appreciate that elements in the drawings are illustrated for simplicity and clarity and have not necessarily been drawn to scale. For example, the relative dimensions of some of the elements in the drawings may be distorted to help improve understanding of embodiments of the present invention.

DETAILED DESCRIPTION OF THE INVENTION

Embodiments of the present invention will be described with reference to a water saving toilet system. For convenience sake, the water saving toilet system will be described herein as a system which provides an adjustable flush volume for a toilet to suit both Australian and overseas standards, with an adjustable range between 0.6 and 4.5 liters. The novel system of present invention will be described hereinafter as being utilised in a normally structured tankless toilet which delivers a rapid stream of water in response to manual activation by a button or handle or other activation means. However, it should be appreciated that embodiments of the present invention can be modified to suit different toilet models, water efficiency requirements and/or standards. It will be appreciated that variations may need to be made as required.

Figure 2:
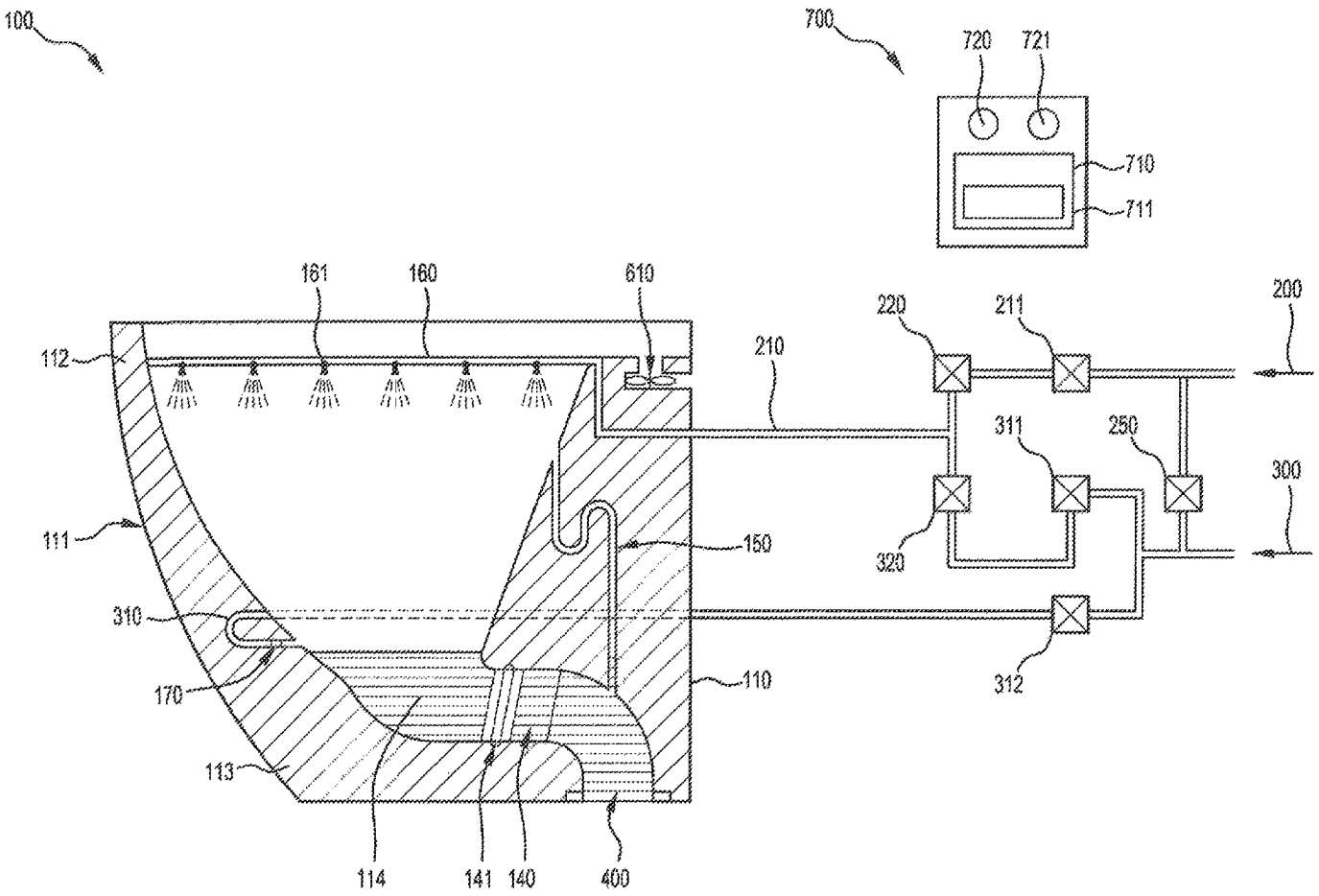
FIG. 2 shows a side cross-sectional view of the water saving toilet system of FIG. 1 showing an alternative position for a flush jet port.
Figure 3:
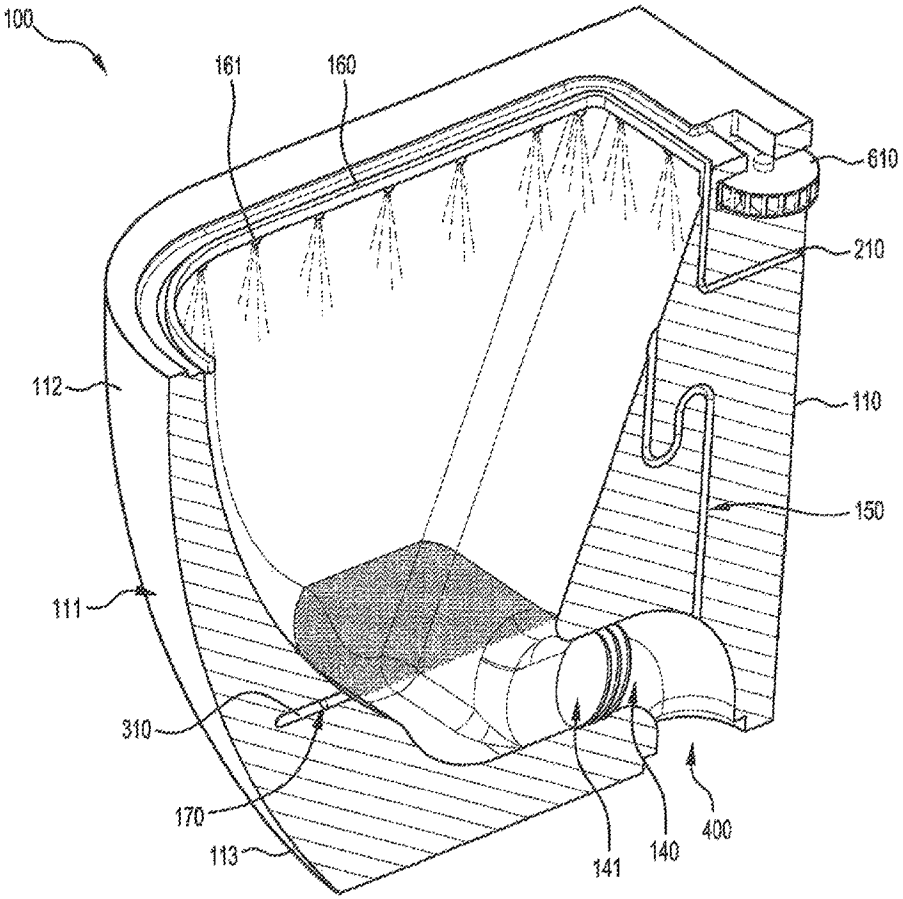
FIG. 3 shows a perspective cross-sectional view of the water saving toilet system of FIG. 1.

Referring to FIGS. 1 to 3, the water saving toilet system 100 is provided in accordance with embodiments of the present invention. The water saving toilet system 100 comprises a toilet 110 having a toilet bowl 111 with an upper portion 112 and/or a lower portion 113. The toilet 110 is in the form of a "blowout" toilet in which the water tank is eliminated in favour of a flush valve, which directs pressurized water from at least one water supply line into upper portion 112 and lower portion 113 of the toilet bowl 111, which will be described in further detail below. The toilet bowl 111 receives waste in a substantially conventional manner. A waste outlet 114 is associated with the lower portion 113 of the toilet bowl 111 and carries waste out of the toilet bowl 111 during flushing.

The toilet bowl 111 comprises a spraying ring 160 having a plurality of jets 161. The spraying ring 160 is mounted below the toilet seat surrounding the rim of the upper portion 112 of the toilet bowl 111. The jets 161 of the spraying ring 160 shoot water around the upper portion 112 to flow from the upper portion 112 to the lower portion 113 of the toilet bowl 111 to both clean the toilet bowl 111 after use and refill the toilet bowl 111 after evacuation. The toilet bowl 111 further comprises a flush jet port 170 mounted at a front area of the lower portion 113 of the toilet bowl 111. When the toilet is flushed, the flush jet 170 shoots water around the lower portion 113 to emulsify and push the waste out of the flushing cavity and into and through the waste outlet 114 at a rear of the lower portion 113 of the toilet bowl 111 into the sewage pipe 400. The flush jet port 170 is located below the water level, as illustrated in FIG. 1. Alternatively, it is envisaged that the flush jet port 170 could be positioned above the water level to ensure all waste is emulsified completely before being flushed through the waste outlet 114 to the sewage pipe 400, as illustrated in FIG. 2.

Referring to FIGS. 1 and 2, the toilet 110 is connected to at least two water sources. A first water source 200 is a clean water source from a mains water supply. A second water source 300 is a grey water supply from a household waste water supply. The toilet 110 is directly connected to the first water source 200 and the second water source 300 via water supply pipe lines 210 and 310 respectively. The water supply pipe lines 210, 310 are of a suitable length to connect to the respective water sources 200, 300 and have a suitable diameter for the pressurised water to flow therethrough. The water supply pipe lines 210, 310 can be made of any suitable material commonly used for plumbing such as copper or the like and can be attached to the toilet 110 and water sources 200, 300 using any suitable means of attachment commonly known in the art.

The water saving toilet system 100 comprises at least one supply valve interposed between the pressurized water supply 200, 300 and the toilet bowl 111 for controlling a volume of water flowing from the water supply 200, 300 to the toilet bowl 111. A first supply valve 211 provides clean water from the first water source 200 and a second supply valve 311 and a third supply valve 312 provide grey water from the second water source 300. The water saving toilet system 100 further comprises a pair of check valves 220, 320 which are designed to prevent the mutual back flow of clean and grey water through the respective water supply pipe lines 210, 310.

The water saving toilet system comprises an electronic controlled device 710 to operate one or more of the valves 211, 311, 312 and regulate the volume of water to flush the toilet. The electronic controlled a led device comprises a timing mechanism 711 connected to one or more of the valves 211, 311, 312 for controlling an amount of time that the valves 211, 311, 312 allow water to flow from the water source 200, 300 to the toilet bowl 111. It is envisaged that the timing mechanism or other suitable electrical device would act to deliver a sufficient minimum amount of pressurised water to flush the waste completely to a sewage pipe 400 and refill the toilet bowl 111 with new clean water for the next use. The valves may be globe valves or any other suitable valve, and the timing mechanism is preferably electronic and programmable such that, it can be set to a desired period of time at the expiration of which, an electronic signal is generated and communicated to close the valves 211, 311, 312. In alternative embodiments of the present invention, it is envisaged that the valves 211, 311, 312 and/or the timing mechanism can be are electrical, mechanical, or a combination thereof. According to a preferred embodiment of the present invention, the valves 211, 311, 312 and the timing mechanism cooperate to limit the total volume of clean and grey water to approximately 0.8 liters for a half-flush and 1.5 liters for a full flush. However, it is envisaged that the exact volumes can be adjusted to suit different country standards and/or requirements. The water saving toilet system 100 comprises at least one bypass valve 250. The bypass valve 250 is located between the first clean water source 200 and the second grey water source 300 such that, the water saving toilet system 100 can still be utilised in circumstances where there is no second grey water source 300.

Provided at the base of the toilet 110 between the toilet bowl 111 and a sewage pipe 400 is a connector 140 having a waste valve device 141. The connector 140 and waste valve device 141 are designed to enable waste to be flushed to the sewage pipe 400 and keep a minimum amount of clean water in the lower part 113 of the toilet 110. An overflow pipe 150 extends from the rear of the toilet bowl 111 to the sewage pipe 400. The overflow pipe 150 is adapted to prevent water and waste water escaping from the toilet in the event of a malfunction. The overflow pipe 150 has a built-in anti-back flow to prevent any gases from the sewage pipe 400 migrating to the toilet 110. In order to maintain an odourless environment, all gases created from any sanitary processes are forced to remain within the toilet 110 and be diverted to an outdoor space via an exhaust system. The exhaust system comprises a fan 610 which is integrated within ducting pipe connected to the water saving toilet system 100.

The water saving toilet system 100 may further comprise a control box 700 coupled to the toilet 110 for controlling the operation of the water saving toilet system 100 and housing the electronic componentry of the system 100. The control box 700 will be located on the wall external to the toilet 110. It is envisaged that the control box will be powered operated via electricity with a provision for a manual flush option in the event of a power outage. The control box 700 can have two manually activated push buttons 720, 721 for providing the reduced volume flush and full volume flush functions respectively. However, in an alternative embodiment it is envisaged that an automated activation mechanism such as a sensor or the like may also be utilised. It is envisaged that the push buttons 720, 721 will be coupled to the timing mechanism 711 and and/or valves in any suitable conventional manner via mechanical or electrical switches, actuating mechanisms or the like.

In use, an embodiment of the water saving toilet system 100 may function substantially as follows. The full flush button 721 is pressed to flush the toilet 110 which, when activated, cause the valve 311 to open and the timing mechanism 711 to start timing a preset period of time. The open valve 311, allows the volume of grey water from the second water source 300 to flow into the spraying ring 160 and be distributed along the first flowpath to clean from the upper portion 112 to the lower portion 113 of the toilet bowl 111 until the timing mechanism causes the valve 311 to close following a pre-determined period of time. As the water supply valve 311 to the second water source 300 closes to stop spraying, the waste valve device 141 and water supply valve 312 are opened to let water flow through the jet port 170 and be distributed along the second flowpath to flush all waste in the lower portion 113 of the toilet bowl 111 to the sewage pipe 400. The waste valve device 141 and water supply valve 312 are then closed simultaneously to seal the lower portion 113 of the toilet bowl 111 and sewage pipe 400. In sequence, the water supply valve 211 is opened to allow a volume of clean water from the first water source 200 to flow into the spraying ring 160 and be distributed along the first flowpath and refill water in the lower portion 113 of the toilet bowl until the timing mechanism causes the valve 211 to close, ready for the next use of the water saving toilet system 100.

For a reduced volume flush, the reduced volume flush button 720 is pressed to flush the toilet 110. The reduced flush button 720 causes the simultaneous opening of the valve 311, to allow the volume of grey water from the second water source 300 to flow into the spraying ring 160 and be distributed along the first flowpath to clean from the upper portion 112 to the lower portion 113 of the toilet bowl 111 and the opening of the waste valve device 141 and water supply valve 312 to let water flow through the jet port 170 and be distributed along the second flowpath to flush all waste in the lower portion 113 of the toilet bowl 111 to the sewage pipe 400. The valve 311, waste valve device 141 and water supply valve 312 are then closed simultaneously, following a pre-determined period of time, to seal the lower portion 113 of the toilet bowl 111 and sewage pipe 400. In sequence, the water supply valve 211 is opened to allow a volume of clean water from the first water source 200 to flow into the spraying ring 160 and be distributed along the first flowpath and refill water in the lower portion 113 of the toilet bowl until the timing mechanism causes the valve 211 to close, ready for the next use of the water saving toilet system 100.

In a further embodiment of the invention, it is envisaged that a nanotechnology anti-stick coating may be applied on the surface of the toilet bowl 111 to facilitate all waste in the toilet process being dropped to lower portion 113 of the toilet 110, without sticking on the upper portion 112 of the toilet 110, and be easily flushed to the sewage pipe 400. Thus, enabling even less water to be utilised by the water saving toilet system.

Hence, the water saving toilet system provides a solution to the aforementioned problems of the prior art by providing an adjustable flush volume for a toilet which is compact and simple to install, maintain and replace. The water saving toilet system of the present invention is a small unit with two water lines attached directly to it thus, making the toilet tank obsolete and eliminating any odour coming from the tank. Furthermore, system of the present invention eliminates the requirement for a trapway pipe such that any waste from the toilet bowl can be directly flushed from the toilet bowl to the waste outlet and sewage pipe, enabling the toilet to have a much more slimmer appearance.

Throughout the specification the aim has been to describe the invention without limiting the invention to any one embodiment or specific collection of features. Persons skilled in the relevant art may realize variations from the specific embodiments that will nonetheless fall within the scope of the invention.

I claim:

1. A water saving toilet system comprising:

a toilet comprising a toilet bowl having an upper portion and a lower portion;

at least one valve interposed between a first water source and a second water source and the toilet bowl for controlling at least one volume of water flowing from the first water source and/or the second water source to the toilet bowl;

a timing mechanism connected to the at least one valve for controlling an amount of time that the valve allows water to flow from the first water source and/or the second water source to the toilet bowl; and wherein the at least one valve and the timing mechanism cooperate to adjust the flush volume.

2. The water saving toilet system of claim 1, wherein the water saving toilet system provides an adjustable flush volume range between 0.6 and 4.5 liters.

3. The water saving toilet system of claim 1, wherein the toilet bowl further comprises a spraying ring having a plurality of jets to shoot water around the upper portion and flow along a first flowpath from the upper portion to the lower portion of the toilet bowl to both clean and refill the toilet bowl after evacuation.

4. The water saving toilet system of claim 1, wherein the toilet bowl further comprises a flush jet port mounted at a front area of the lower portion of the toilet bowl to shoot water around the lower portion and flow along a second flowpath which emulsifies and pushes the waste out of the flushing cavity and into and through a waste outlet at a rear of the lower portion of the toilet bowl into a sewage pipe.

5. The water saving toilet system of claim 1, wherein the first water source is a clean water source from a mains water supply and the second water source is a grey water supply from a household waste water supply.

6. The water saving toilet system of claim 1, wherein a first supply valve provides clean water from the first water source and a second supply valve and a third supply valve provide grey water from the second water source.

7. The water saving toilet system of claim 1, wherein the water saving toilet system further comprises a pair of check valves which are designed to prevent the mutual back flow of clean and grey water through water supply pipe lines.

8. The water saving toilet system of claim 1, wherein the water saving toilet system further comprises a connector having a waste valve device to enable waste to be flushed to the sewage pipe and keep a minimum amount of clean water in the lower part of the toilet bowl.

9. The water saving toilet system of claim 1, wherein the water saving toilet system further comprises an overflow pipe extending from the rear of the toilet bowl to the sewage pipe.

10. The water saving toilet system of claim 9, wherein the overflow pipe has a built-in anti-back flow to prevent any gases from the sewage pipe migrating to the toilet.

11. The water saving toilet system of claim 1, wherein the water saving toilet system further comprises an exhaust system comprising a fan which is integrated within ducting pipe connected to the water saving toilet system for diverting all gases created from any sanitary processes to an outdoor space.

12. The water saving toilet system of claim 1, wherein the water saving toilet system further comprises a control box coupled to the toilet for controlling the operation of the water saving toilet system and housing the electronic componentry of the system.

13. The water saving toilet system of claim 12, wherein the control box will be powered operated via electricity with a provision for a manual flush option in the event of a power outage.

14. The water saving toilet system of claim 12, wherein the control box has two push buttons for providing the reduced volume flush and full volume flush functions.

15. The water saving toilet system of claim 1, wherein the system further comprises at least one bypass valve located between the first clean water source and the second grey water source such that, the water saving toilet system can still be utilised in circumstances where there is no second grey water source.

* * * * *